US005174055A

United States Patent [19]

Aiken

[11] Patent Number: 5,174,055

[45] Date of Patent: Dec. 29, 1992

[54] SCROLLING SIGN

[76] Inventor: Robert B. Aiken, 11039 N. River Trail, Mequon, Wis. 53092

[21] Appl. No.: 570,324

[22] Filed: Aug. 21, 1990

Related U.S. Application Data

[63] Continuation-in-part of Ser. No. 190,034, May 4, 1988, Pat. No. 5,016,371.

[51] Int. Cl.[5] ..... G09F 11/18

[52] U.S. Cl. ..... 40/518; 40/471

[58] Field of Search ..... 40/471, 472, 478, 512, 40/518-529

[56] References Cited

U.S. PATENT DOCUMENTS

| | | | |
|---|---|---|---|
| 432,914 | 7/1890 | Terrell et al. | 40/522 |
| 1,494,611 | 5/1924 | McGrew | 40/519 X |
| 2,021,362 | 11/1935 | Holsman | 40/472 |
| 2,563,580 | 8/1951 | Clark | 40/518 |
| 3,426,461 | 2/1969 | Miller | 40/471 |
| 3,496,664 | 2/1970 | Gaffney et al. . | |
| 3,510,973 | 5/1970 | Mazzocco, Sr. | 40/471 |
| 3,780,458 | 12/1973 | Jacoby et al. | 40/471 |
| 4,680,883 | 7/1987 | Stadjuhar et al. | 40/471 |

FOREIGN PATENT DOCUMENTS

| | | | |
|---|---|---|---|
| 538138 | 11/1931 | Fed. Rep. of Germany | 40/471 |
| 2514074 | 10/1976 | Fed. Rep. of Germany | 40/471 |
| 3725788 | 3/1988 | Fed. Rep. of Germany | 40/518 |

*Primary Examiner*—Kenneth J. Dorner
*Assistant Examiner*—Milton Nelson, Jr.
*Attorney, Agent, or Firm*—Andrus, Sceales, Starke & Sawall

[57] ABSTRACT

A scrolling sign apparatus is suitable for incorporation in existing sign enclosures. Brackets are inserted in the enclosure. A web and web roll assembly is removably fastened to the brackets. The web and web roll assembly include a pair of spaced web rolls with a web extending between them. The web may extend between a pair of transparent sheets for displaying graphic or alpha-numeric information provided on the web. The information may be provided on separate sheets that are taped to the web. Or an inner transparent sheet is mounted in the module behind the web. Guide flanges are mounted on the other side of the web to form a gap through which the web extends between the rolls. The gap has a narrowed portion along the path. The slack occurring in the sheets when said panel appears in the window is forced to the ends of the panel by the narrowed portion of the gap, thereby to present a highly aesthetic appearance to the sign.

12 Claims, 6 Drawing Sheets

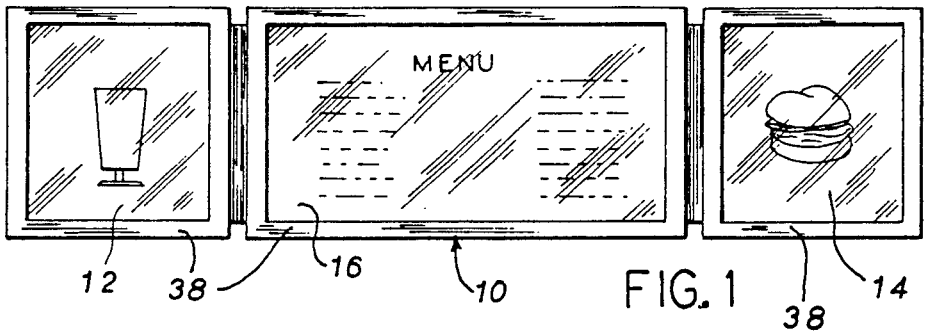
FIG. 1
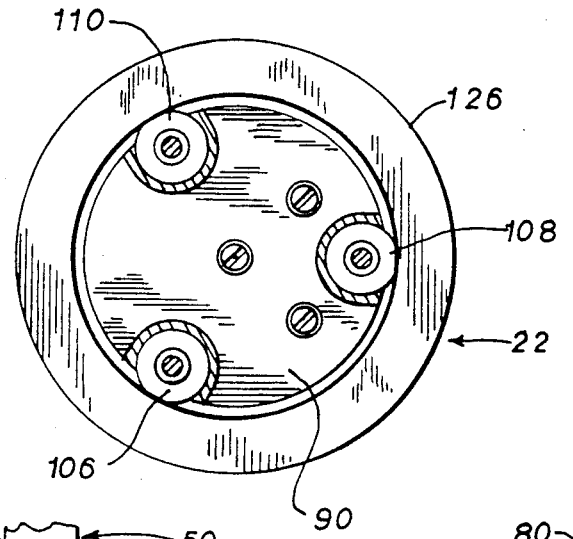
FIG. 4
FIG. 3
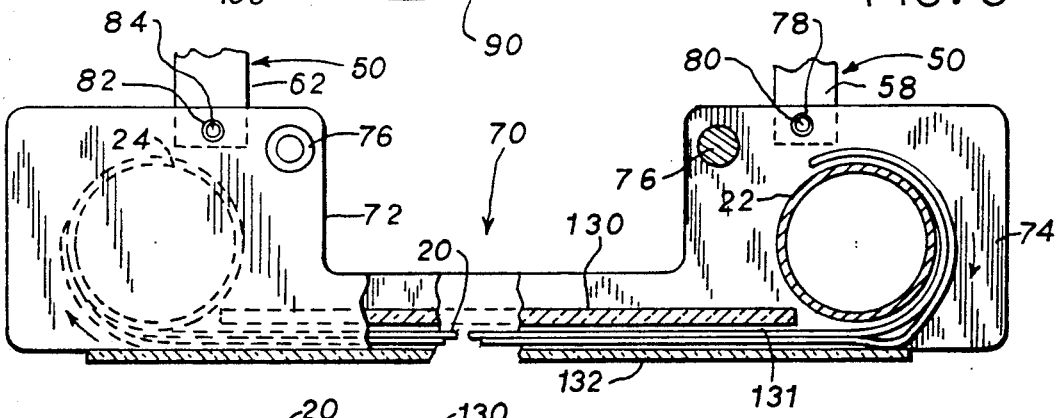
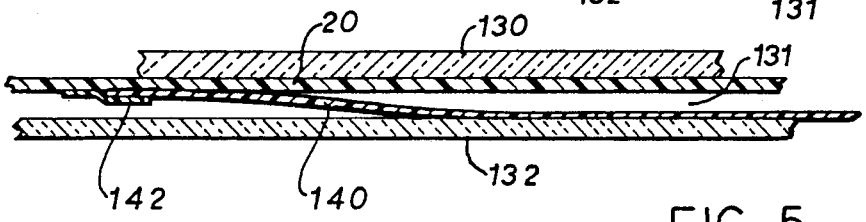
FIG. 5

FIG. 11
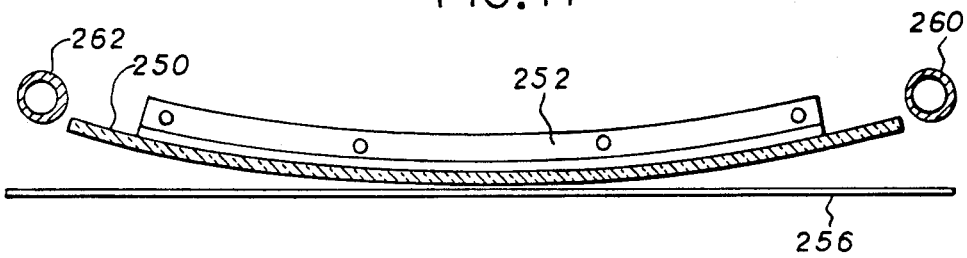
FIG. 12
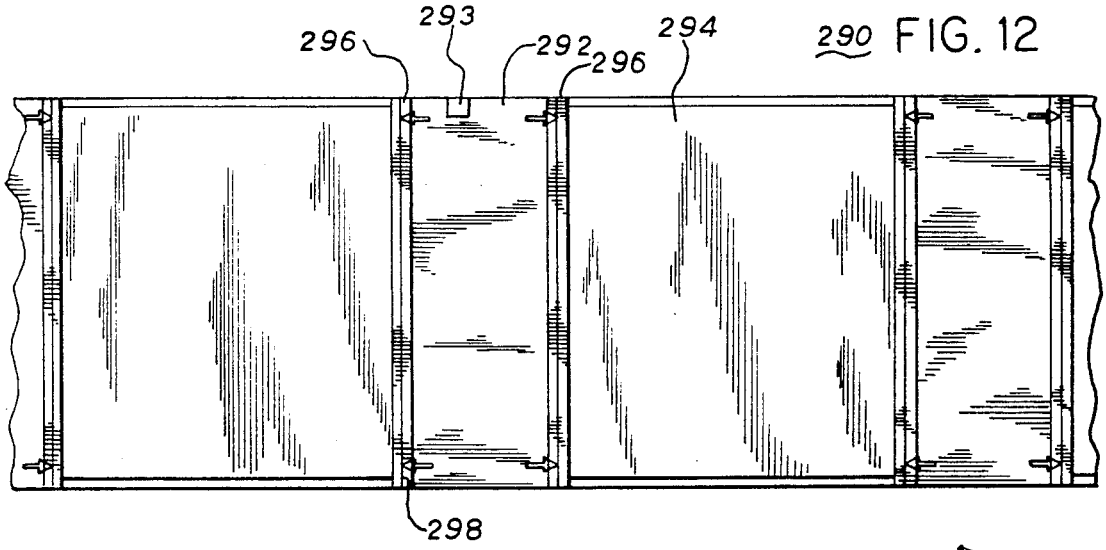
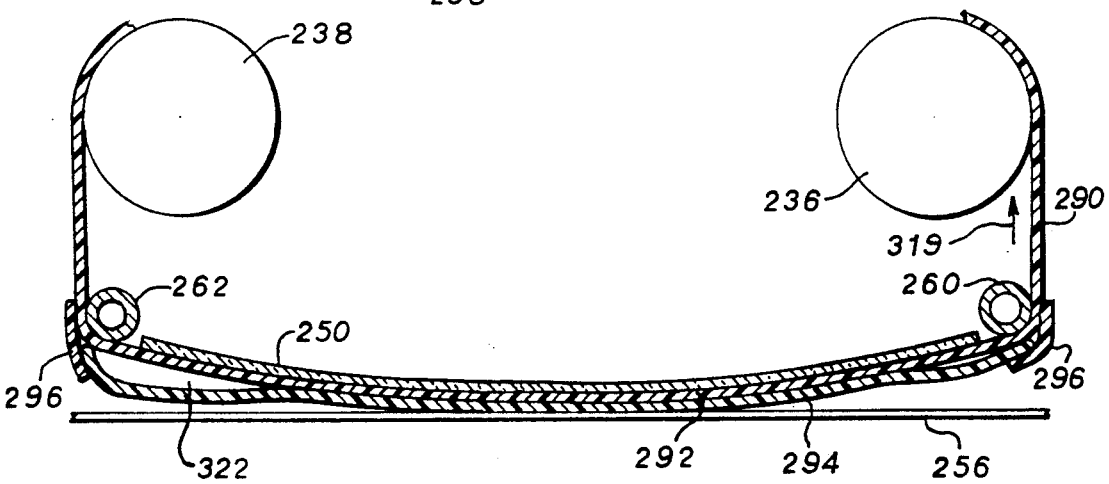
FIG. 13

SCROLLING SIGN

The present application is a continuation-in-part application of applicant's earlier application Ser. No. 190,034, filed May 4, 1988 and now U.S. Pat. No. 5,016,371 issued on May 21, 1991.

The present invention relates to a scrolling sign in which the display of graphic or textual information may be changed by scrolling a web containing the information across a viewing window in the sign. More particularly, the present invention is directed to a sign of the foregoing type in which the information is contained on individual sheets that are removably mounted on the web.

There are numerous applications in which it is desirable to change the information displayed by a sign. Typical of such applications are signs involved in the advertising and merchandising of products. In such signs, it is often desired to change information regarding the availability of a product for sale, pricing, and other data. For example, in restaurants, particularly those of the fast food type, pricing, pictures of food items, and other information are displayed on a menu board sign. The menu board may be above the service counter, exterior to the restaurant, or elsewhere. All or a portion of the menu board may be back-lit to draw attention to the sign and increase its legibility.

It would be desirable in circumstances such as this to be able to change graphics, such as pictures of menu suggestions, and/or associated alpha-numeric information, such as descriptions, portion sizes, or pricing, at various times. For example, these changes could occur in connection with menu suggestions for breakfast, lunch, or dinner. This type of information would be changed regularly on a daily basis.

In addition to these daily changes, it would also be desirable to have the capability of accommodating less frequent changes of information, for example, the display of information relating to merchandise suitable for a particular season, or for a special event or promotion, or for a special target market of customers.

At present, existing signs, such as menu boards typically use slip-in sheets for the graphics and individual characters or groups of characters for alpha-numeric information, such as product name and price. This makes changes difficult and prone to error. Particularly, the characters are subject to loss or damage. The visual aspects of the sign may also suffer.

The use of a scrolling sign overcomes many of the above noted disadvantages. A typical scrolling sign is that shown in U.S. Pat. No. 4,741,118 issued May 3, 1988 to the present inventor, and others. In such a sign, the information is printed or coated on the web which is scrolled past a window in the sign. While such a sign permits the alpha-numeric information to be changed, the changes are limited to those printed on the web. If additional changes are desired, it is necessary to change the web in the sign.

To alter the information available on the web, prior art patents have placed the information on sheets or panels that may be removably mounted to a supporting strip. See, for example, U.S. Pat. No. 3,510,973 to Mazzocco, Sr. and U.S. Pat. No. 3,780,458 to Jacobi, et al. The sheets or panels containing the information may be removably affixed to the strip by clips, pins, or tape.

However, the web now contains two thicknesses of material—the information bearing panels and the supporting strip. As the web is unwound from a supply roll, passed in front of the window in the sign, and wound up on a take-up roll, slack will develop in either the strip or the panels. This is because the strip and panel will have different radii when wound on the rolls. If there is no slack in the strip and panels as they pass the window, slack will appear on the rolls. This may make rolling and unrolling of the web difficult, adds to the bulk of the web when wound on the rolls, and may limit the number of panels that can be placed on the strip. If the strip and panels are tight on the rolls, the slack will appear in one or the other of the strip and panels as they pass the window. This will cause buckling in the web as the information is displayed, detracting from the aesthetic features of the sign. The service life of the web may be lessened by the slack and buckling appearing in the web.

Various techniques have been devised to overcome this problem. For example, the Mazzoco, Sr. patent utilizes resilient fastening strips for the panels. Or, the panels may be provided with crimped portions that expand and contract to remove the slack in the panels. A further approach, also shown in the Mazzoco, Sr. patent, is to provide the panels with slots that engage button like tabs on the strip. The movement of the tabs in the slots accommodates the slack in the panels and strip.

None of these approaches are completely satisfactory. The use of special clips or tabs alters the smoothness of the web and may make it difficult to change panels. The same is true of placing crimps in the panels. The tabs and crimps increase the build up of the web when on the rolls, decreasing the number of panels that can be placed on the web. All of the foregoing approaches add to the cost of the sign.

The Jacobi patent butts a plurality of panels together and holds them with tape to form the web without the use of a supporting strip. This may result in a loss of strength in the web and increased breakage. Additionally, the need to break the web in order to change the information often makes it difficult to make the changes in a sign using a scrolling web and to organize the material contained on the web.

It is therefore the object of the present invention to provide further improvements in a scrolling sign of the type in which the information to be displayed by the sign is provided on individual panels that are removably mounted on a supporting strip that is scrolled between an unwind, or supply, roll and a take up roll. The sign of the present invention overcomes the shortcomings heretofore encountered in signs of this type. It provides a highly aesthetic display of the information provided on the panels mounted on the web. The sign of the present invention facilitates the application and changing of the panels on the supporting web.

The scrolling sign of the present invention can be incorporated or retrofitted in a conventional sign enclosure and can be inserted and removed for maintenance and replacement.

The sign may employ graphic materials of the type utilized with conventional menu boards, while storing same in the scrolling sign apparatus. The graphic, as well as other informational materials, may be easily added to, or removed from, the apparatus. The graphic and/or other informational material are protected both during use and storage. The scrolling sign apparatus of the present invention also lends itself to remote or automatic operation.

Briefly, the present invention includes a sign module positionable within a sign enclosure having a viewing window. A pair of spaced web rolls are journaled for rotation in the module with a web extending between the rolls for movement along a path in the module as a result of its being unwound and rewound on the rolls. The web comprises a strip having mounted thereon one or more panels arranged in series along the web. The panel contains informational or viewing material. The panel is so mounted on the strip that the strip and sheet are rolled up smoothly and with controlled tension on the rolls. The rolling up of the sheets on the rolls serves to store the rolls to prevent their loss.

A first guide means is mounted in the module and positioned behind the web. A second guide means is mounted in the module on the other side of the web to form a gap through which the web extends in its path between the rolls. The gap between the first and second guide means is narrowed along the path of the web, typically in a location which is centered with respect to the rolls. The slack occurring in the panel when the panel appears in the window of the enclosure is thus forced to the ends of the panel by the narrowing of the gap. It is thus insured that the panel will appear flat in the window of the sign so as to provide a highly effective and aesthetically pleasing display of the information on the panel. Guide rollers located at the ends of the sheet facilitate the movement of the web. The first guide means may have a transparent sheet associated therewith.

The invention will be more fully understood from the following detailed description, taken in conjunction with the drawing. In the drawing:

FIG. 1 shows a sign enclosure, such as a menu board, with which the scrolling sign apparatus of the present invention may be employed;

FIG. 3 is a generally horizontal cross sectional view of the scrolling sign apparatus of the present invention and showing its operation;

FIG. 4 is a view taken along the line 4—4 of FIG. 2;

FIG. 5 is a fragmentary view also showing operation of the scrolling sign apparatus of the present invention.

FIG. 11 is a cross sectional view similar to FIG. 10 but simplified and with certain aspects exaggerated to show a feature of the present invention;

FIG. 12 is a front view of the web showing the manner in which the information bearing panels are fastened to the strip to form the web; and FIG. 13 is a cross sectional view similar to FIG. 11 showing the manner in which slack in the web is accommodated by the scrolling sign of the present invention.

Figure 2:
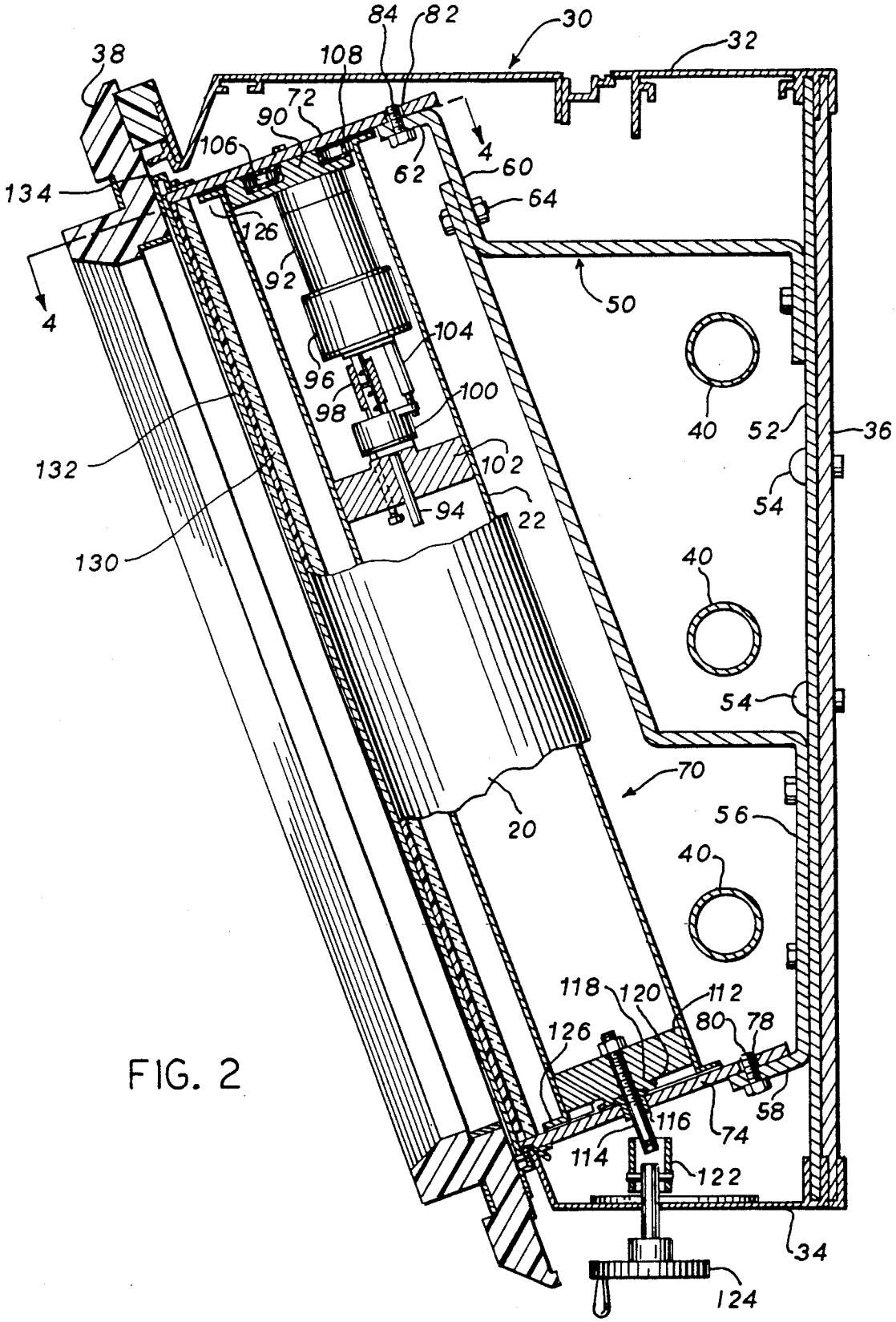
FIG. 2 is a generally vertical cross sectional view through the sign enclosure showing the scrolling sign apparatus of the present invention.

FIG. 1 shows sign 10. Sign 10 may, for example, comprise a menu board for a restaurant. End panels 12 and 14 contain graphic displays of menu suggestions. Center panel 16 contains alpha-numeric information such as the description and price of menu items. Sign 10 may contain lights behind the panels for illuminating same.

In conventional signs, the graphic displays are provided on sheets of translucent material, such as plastic, that are illuminated by the lights in the sign. The sheets are slid into frames that surround and form the panels, such as 12 and 14. The alpha-numeric information may be provided as individual characters, such as letters, or numbers or groups of characters, such as the name and/or price of a menu item. The characters rest on rails or other holders in center panel 16 and are suitable for being back lit. The graphic displays are changed by removing one sheet from the frame and inserting another sheet. The alpha-numeric information is changed by exchanging the characters on the holders.

The scrolling sign apparatus of the present invention provides for changing information in a sign, such as a menu board, by scrolling a web 20 between two spaced web rolls 22 and 24 across one or more panels of sign 10, in the manner shown generally in FIG. 3. The graphic displays, such as menu suggestions, and/or alpha-numeric information, such as menu item descriptions and prices, are provided on the web. The web is unwound from one roll and wound up on the other roll to move the desired information into the panel(s) for display purposes.

FIG. 2 shows details of the scrolling sign apparatus of the present invention. Sign 10 includes an enclosure 30 having upper wall 32, lower wall 34 and back wall 36. The front of enclosure 30 includes removable frames 38 that surround the panels in sign 10. Enclosure 30 typically contains lights 40 of the fluorescent type for back lighting the sign.

The scrolling sign apparatus of the present invention includes horizontally spaced brackets 50 for mounting the apparatus in enclosure 30. One such bracket 50 is shown in detail in FIG. 2. Bracket 50 includes strap 52, the upper and lower ends of which abut upper and lower walls 32 and 34, respectively, of enclosure 30. If desired, strap 52 may be joined to back wall 36 of enclosure 30 by any suitable means 54, such as nuts and bolts, expandable rivets, and the like. Bracket 50 includes lower support member 56, fastened to strap 52, and having flange 58 at the lower end thereof. Bracket 50 also includes upper support member 60 fastened to strap 52 and having flange 62 at the upper end thereof. Support members 56 and 60 may be joined together in their overlapping portions as by bolt and nut 64, spot welding, or other suitable means. The use of brackets 50 permits retrofitting the scrolling sign apparatus into existing sign enclosures.

The scrolling sign apparatus of the present invention also includes a web and web roll assembly 70 mounted to brackets 50. The web and web roll assembly 70 contains web 20 and web rolls 22 and 24. The web roll assembly includes upper and lower plates 72 and 74 in which the web rolls are journalled for rotation. Upper and lower plates are joined together by rods 76, shown in FIG. 3, to form the plates into a frame for assembly 70. Lower plate 74 contains holes 78. Bolts 80, threaded through flanges 58 on lower support members 56, extends into holes 78. Upper plate 72 contains holes 82. Bolts 84 threaded through flanges 62 on upper support members 62 extends into holes 82. In this manner, web and web roll assembly 70 is mounted on brackets 50 and, hence in enclosure 10. The web and web roll assembly avoids interference with lights 40 yet is properly positioned with respect to them. The web and web roll assembly can be easily removed from enclosure 10 for maintenance or other purposes, by flexing brackets 58 and 62 to remove bolts 80 and 84 from holes 78 and 82, and sliding assembly 70 out of enclosure 10. The process is reversed during installation of the assembly.

The web rolls 22 and 24 are mounted for rotation on upper and lower plates 72, 74. FIGS. 2 and 3 show the manner of such mounting for web roll 22. Motor mounting bracket 90 is mounted on the lower surface of upper plate 72 to mount motor 92. Motor 92 rotates output shaft 94 through speed reducing gear box 96. Output shaft 94 extends through universal joint 98 to the rotor of clutch 100. Output shaft 94 is rotatably journalled in plug 102 for supporting the shaft while permitting relative rotation between the shaft and the plug. Plug 102 is affixed to the inner wall of roll 22. The housing of clutch 100 is non-rotatably retained on the housing of motor 92 by bar 104.

Clutch 100 may be of the electrically operated type having a low voltage field coil that serves, when energized, to couple a rotor mounted on shaft 94 with an armature drivingly connected to plug 102 to cause shaft 94 to rotate plug 102 and web roll 22. When the field coil is de-energized, driving engagement of the armature with the rotor is lost and the shaft does not drive plug 102 and web roll 22. A clutch suitable for use in the scrolling sign apparatus of the present invention is that manufactured and sold by Warner Electric Brake and Clutch Co. of South Beloit, Ill. under the designation SF-120 or XA-104-10-025. Further details of such clutches are provided in published patent application WO 87/07745, published Dec. 17, 1987 and in U.S. patent application Ser. No. 4,741,118.

The use of a motor and clutch internal to the web rolls provide a compact construction to the scrolling sign apparatus that permits retrofitting in a wide variety of enclosures and minimizes interference with other components, such as lights 40.

As shown most clearly in FIG. 4, motor mounting bracket 90 contains rollers 106, 108, and 110 to support and guide the upper end of web roll 22. The lower end of web roll 22 contains plug 112 having axle 114 journalled in bearing 116 in lower plate 74.

Roll 22 may be provided with a braking means that provides a greater amount of braking or retarding action when the web is being unwound from web roll 22 than when it is being rewound onto the web roll. This prevents free wheeling of the web rolls during operation of the scrollings sign apparatus. To this end, plug 112 may include collar 118 containing a groove. A spring wire 120 bent in a generally circular fashion is provided in the groove, to embrace the collar. An end of the spring wire is anchored in lower plate 74. The differential braking action is obtained by the tendency of the spring to wrap around collar 118 in one direction of rotation but not in the other. The braking means is further described in the aforesaid published PCT application and U.S. patent.

In the event it is not desired to drive the web rolls 22 and 24 from the associated motors 92, means are provided to manually rotate the web rolls. Specifically, axle 114 is coupled through coupler 122 to hand crank 124 extending through lower wall 34 of enclosure 30.

Web roll 22 contains upper and lower flanges 126 to assist in guiding and retaining web 20 on the web rolls.

The construction of web roll 24 resembles that of the web roll 22 described, in detail, above.

Light transmitting sheet 130 extends between upper and lower plates 72 and 74 along the front of the scrolling sign apparatus and intermediate web rolls 22 and 24. Sheet 130 may be formed of a material, such as transparent or translucent plastic, and can be fastened to the upper and lower plates by screws extending through the plates and into the edges of the sheet. Exterior sheet 132 may be spacedly mounted on plates 72 and 74 with respect to sheet 130 to provide a spacing or gap 131 between the sheets through which web 20 extends. Sheet 132 is formed of a transparent material, such as plastic. Sheets 130 and 132, lying on both sides of web 20, serve to encapsulate web 20 and protect it from dirt and other deleterious factors when the web is displayed in frame 38. Sheet 132 may be affixed to upper and lower end plates 72 and 74 by clips, one of which is shown in FIG. 2 at 134. The periphery of sheet 132 may be rendered opaque, as by painting, to serve as a mask and prevent light leaks around frame 38.

Web 20 may be formed of a flexible transparent or translucent plastic, such as polycarbonate or other suitable material. Polycarbonate plastic material is advantageous in that it can act as a filter of the ultraviolet light of lights 40 for information placed on the front side of web 20. The graphic displays or alpha-numeric information to be displayed in sign 10 may be printed directly on web 20 and, preferably the front side thereof. Or, the graphic or informational materials may be printed on separate sheets 140 that are attached to web 20. This permits the graphic or informational materials to be applied to, and removed from, the web as desired. Or, portions of web 20 may contain printed materials, such as standard displays or information, and other portions of the web left blank to permit the attachment of separate sheets 140 showing special or seasonal items.

FIG. 5 shows one manner of fastening separate sheets 140 to web 20. Web 20 has separate sheet 140 containing graphic or alpha-numeric information applied to the surface facing exterior sheet 132. Sheet 140 may be held on web 20 by an adhesive tape 142. To affix the sheet 140 to web 20, one end of the sheet 140 is taped to web 20. The web 20 and sheet 140 are rolled up on one of the web rolls. The remaining end of sheet 140 is then taped to the web. Sheet 140 may be removed by loosening the tape. The foregoing arrangement permits the scrolling sign apparatus of the present invention to use the same graphics or informational sheets that are commonly used in signs of the non-scrolling type. Or, thinner, less expensive sheets may be used because of the support provided to the sheets by web 20.

Other means, for example resilient filamentary hook and eye fastener strips (Velcro) or deformable plastic fastening strips (Ziplock) may be used, if desired.

The surfaces of sheets 130 and 132, web 20, and sheets 140 that are likely to come in contact during operation of the scrolling sign apparatus may be formed of abrasion resistant material or may be provided with an abrasion resistent coating, if desired.

Because of the different radii of web 20 and sheet 140 when rolled up on the web rolls, when web 20 is flat in the gap 131 between plates 130 and 132, as shown in FIG. 5, sheet 140 will have a slight bulge. This is accommodated in gap 131, as by a minor bending or buckling of the sheet.

As shown in FIG. 3, the end configuration of sheets 130 and 132 is such to insure that tape 142 and any bulges in separate sheet 140 as web 20 is unwound can be accommodated during the unrolling process. For this purpose plate 132 extends beyond plate 130 and beyond the point of tangency with rolls 22 and 24 in the manner shown in FIG. 3. This insures that tape 142 and any bulges in sheet 140 will strike the flat surface of sheet 132 rather than its edge and will slide into gap 131 between sheets 130 and 132.

In operation, motors 92 are energized to rotate output shafts 94. One or the other of clutches 100 is energized to rotate one of web rolls 22 or 24 in a direction that causes the web 20 to be wound up on that web roll. The web is unwound from the other web roll. The differential braking action provided by spring wire 120 on collar 118 insures that, particularly the unwinding roll does not free wheel. The surface contact of web 20 with a sheet 130 maintains tension in web 20. When the information on web 20 is positioned in the desired location in sign 10, the clutch 100 is de-energized so that the desired material remains in the panel(s) of the sign. Motors 92 may then be de-energized.

Or, hand crank 124 may be operated to move the web into the desired position. The differential braking action provided by spring wire 120 and groove 118 tends to permit the hand cranks 124 to be operated in the windup direction only. If more positive action is desired or required, one way clutches or ratchets may be interposed between hand cranks 124 and rolls 22 and 24 to insure operation only in the windup direction. This avoids slack in web 20. Where solely manual operation is desired, motors 92 and the attendant elements can be omitted and the upper ends of rolls 22 and 24 provided with shafts journalled in plate 72.

It will also be appreciated that, if desired, the operation of motors 92 and clutches 100 may be automated to any desired extent. Thus, web 20 or sheet 140 may be provided with appropriate indexing or coding marks that coact with optical scanning means so that movement of web 20 stops when the desired information is displayed in the sign. Or, a simple indexing mark may be provided on web 20 that indicates the position of the web with respect to frame(s) 38. A jog-type control is used to step the desired graphics into frame(s) 38 by watching the movement of web 20 in sign 10. Or, the movement of web 20 may be controlled by a clock to display certain information at certain times of the day. The movement of web 20 in sign 10 may be such that a desired information is moved into sign 10, remains in the frame for a predetermined period of time, is moved out of sign 10, and replaced with different information. The winding direction of web 20 and web rolls 22 and 24 may be automatically reversed when the web approaches the completely unwound state on one or the other of the web rolls.

Figure 6:
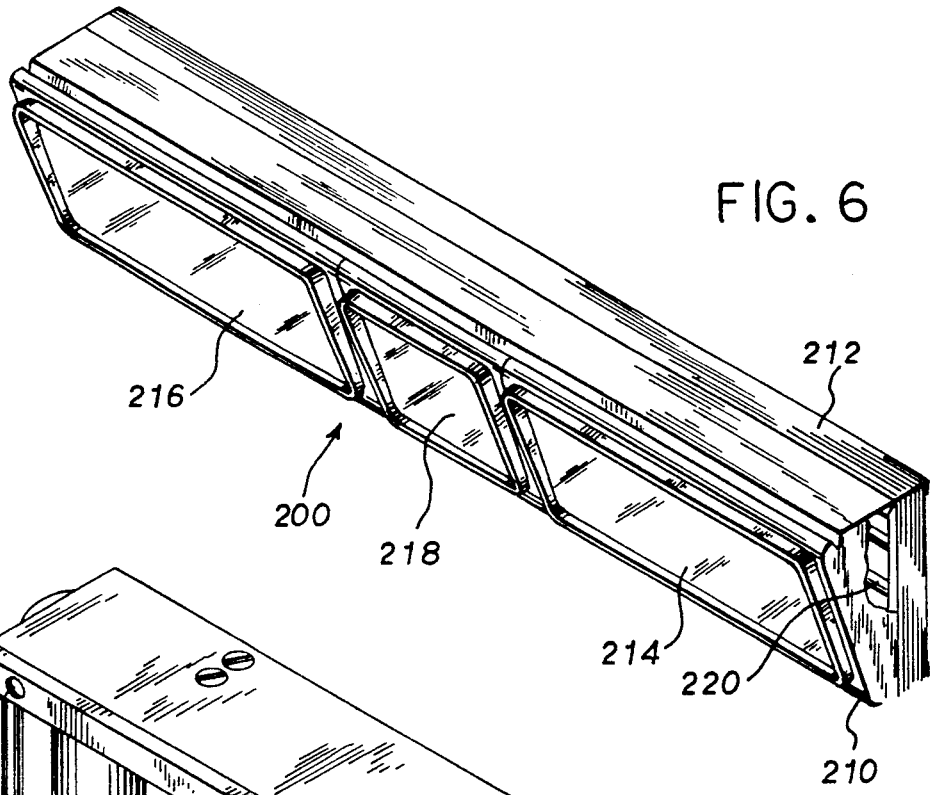
FIG. 6 is a perspective, partially broken away, view of another embodiment of a scrolling sign of the type contemplated in the present invention.

FIG. 6 shows another embodiment of the scrolling sign of the present invention. The sign is identified by the numeral 210. Sign 210 is shown as a menu board for a restaurant, it being understood that this is for illustrative purposes only and the present invention is in no way limited only to such an application.

Sign 210 includes a housing 212 and may contain a pair of end windows 214 and 216 that contain alphanumeric information, such as the description and price of menu items for the restaurant. Center window 218 may contain a graphic display of menu suggestions. Sign housing 212 contains lights 220 behind the windows so that information appearing in the windows is back lit to the observer. Lights 220 may typically be of the flourescent type.

Sign 210 includes one or more scrolling modules 230. Typically, one module will be provided for each window in sign 210. The module for the smaller center panel 218 is shown in detail in FIGS. 7, et seq. The scrolling modules for end windows 214 and 216 generally resemble that shown and described herein, with the modifications necessary for the longer windows.

The scrolling modules scroll a web across a window of the sign to permit the information in the sign to be changed. For this purpose, the web is unwound from one roll in the module, passed across the window, and rolled up on another roll in the module to move the desired information into and out of the window.

Figure 7:
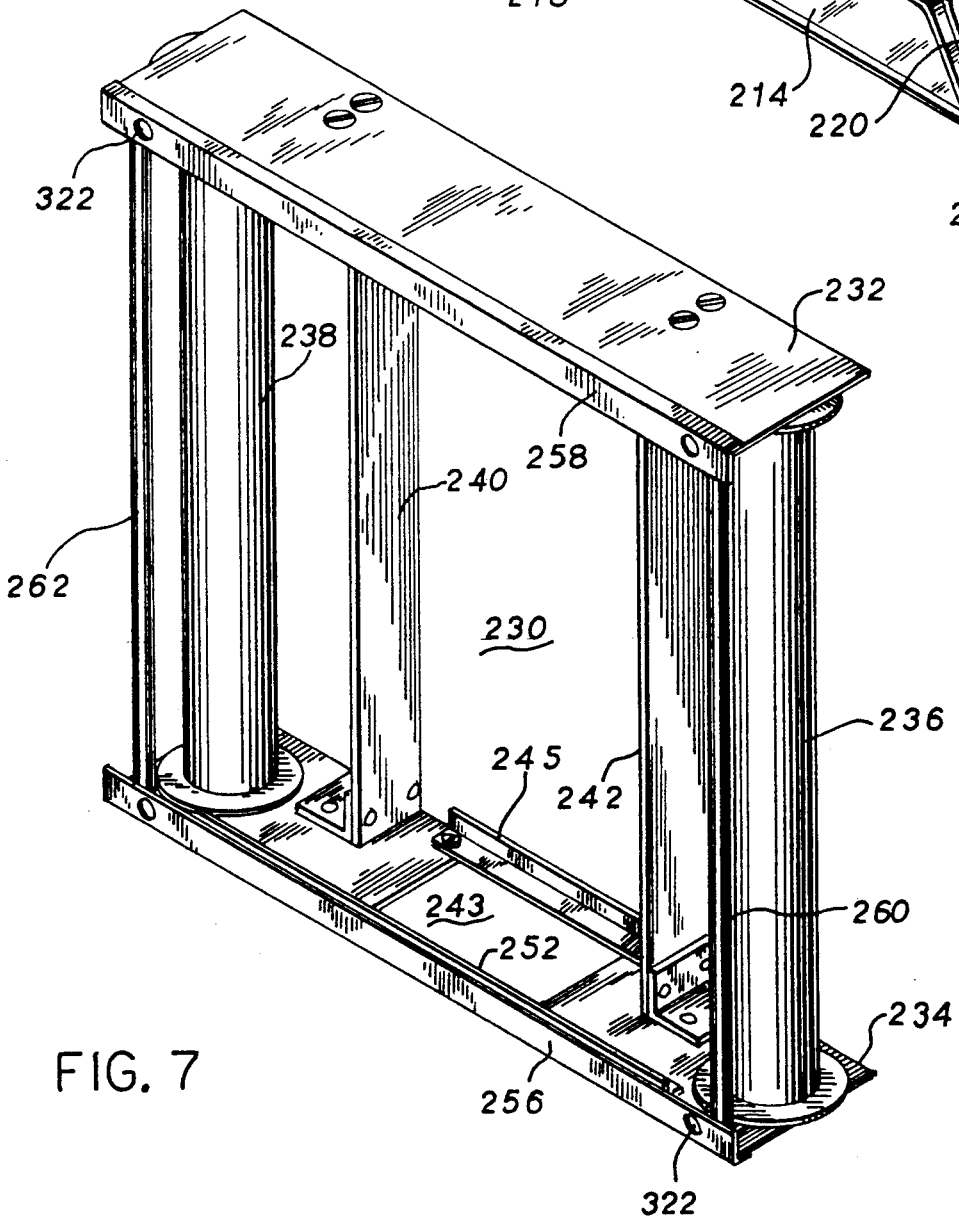
FIG. 7 is a perspective view of a sign module for the sign of FIG. 1, the module being shown without the web.

As shown in FIG. 7, sign module 230 includes rectangular upper plate 232 and lower plate 234 in which web rolls 236 and 238 are journaled for rotation. Upper plate 232 and lower plate 234 are joined together by columns 240 and 242. Lower plate 234 contains cut-out 243 for permitting module 230 to straddle a pair of lighting units and/or a vertical electrical raceway in housing 212, thereby to lend flexibility to the positioning of sign module 230 in housing 212. Brace 245 may be employed on lower plate 234 during shipping or if lighting units or raceway do not need to be accommodated..

A first guide means in the form of a flange member 252 is mounted proximate one of the longer edges of plate 234. Flange member 252 has a horizontal portion fastened to plate 234 and an upstanding vertical portion. Flange member 252 may have a vertical sheet of material 250 connected to the vertical portion for providing structural rigidity to sign module 230. The sheet is omitted from FIG. 2, for reasons of clarity, but is shown in FIGS. 8, 9, 10, 11 and 13. The sheet is preferably formed of light transmitting material to permit sign 210 to function in a back-lit manner. As seen in exaggerated form in FIG. 11, flange member 252 may be bowed in the center so that the center of the vertical portion, and hence sheet 250, lies closer to the edge of lower plate 234 than do the end portions. A similar flange member 254 is mounted on the lower surface of upper plate 232, as shown in FIG. 3. A guide flange 256, 258 for the web is provided along each of the longer edges of plates 232 and 234. The gap between guide flanges 256, 258 and sheet 250 forms a path between web rolls 236 and 238 for the web to move as it is unwound and rewound on the rolls. The gap is narrowed in the center portion due to the curvature of flanges 252 and 254.

Figure 10:
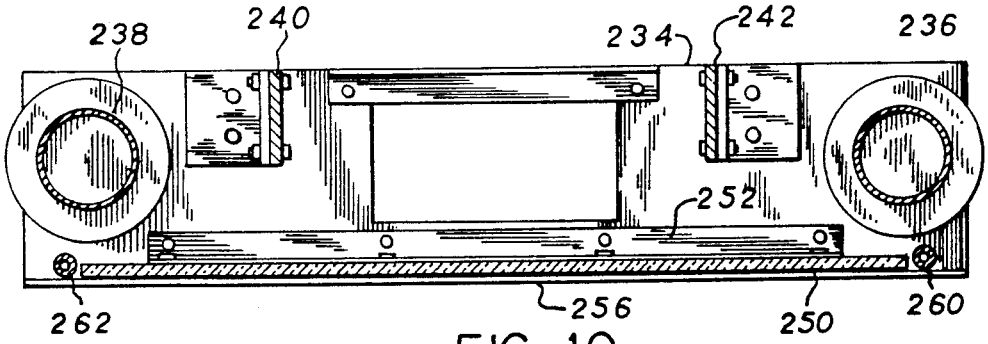
FIG. 10 is a cross sectional view of the sign module taken along the line 10—10 of FIG. 9.
Figure 9:
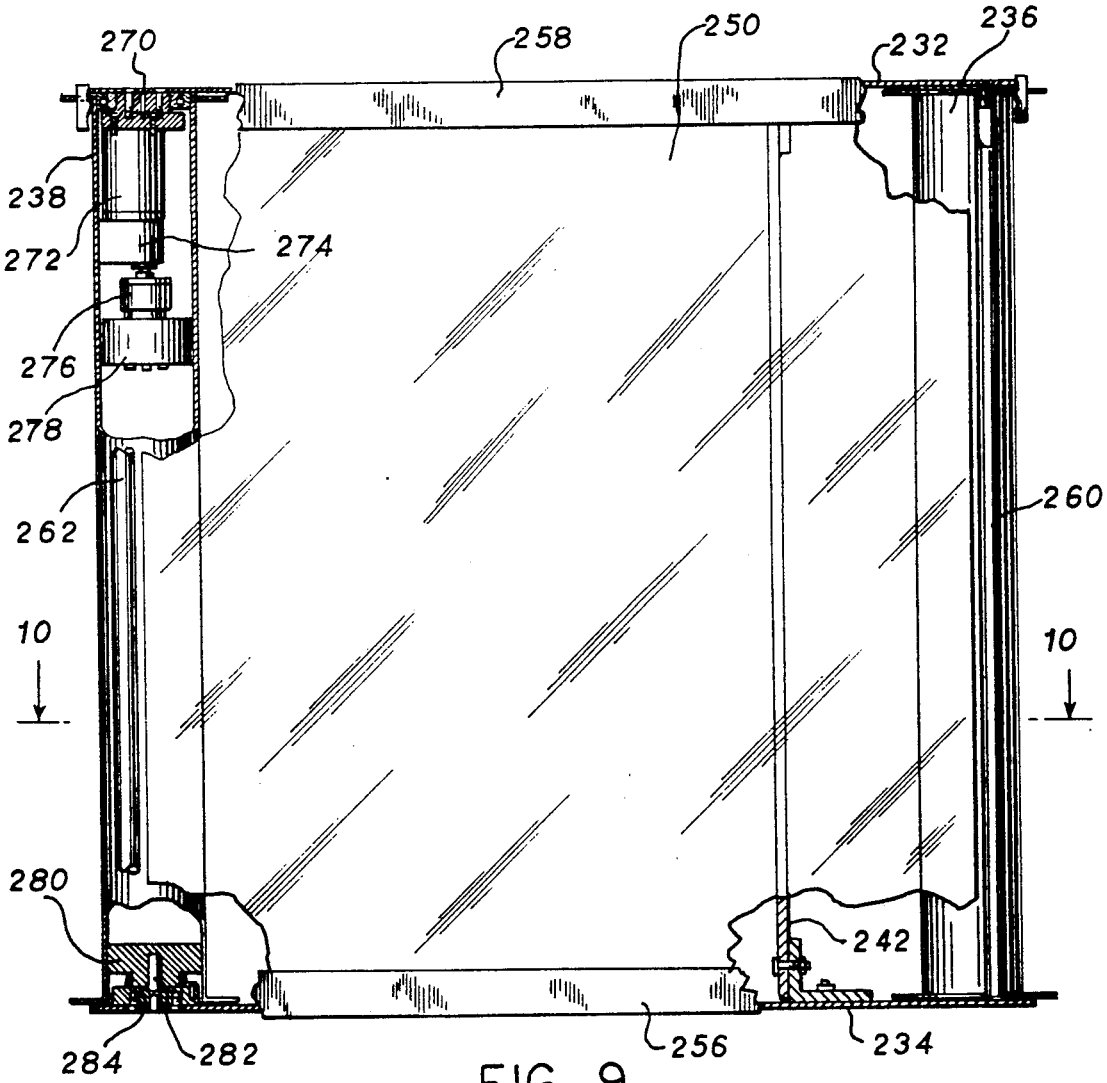
FIG. 9 is a partially broken away front view of the sign module.

Guide rollers 260 and 262 are mounted at each end of sheet 250. Guide rollers 260 and 262 are journaled for rotation in plates 232 and 234. As shown in FIG. 11, the peripheral surfaces of guide rollers 260 and 262 are preferably in line with the outer surface of sheet 250. Further, guide flanges 256, 258 extend beyond rollers 260, 262, also as shown in FIG. 10 and elsewhere in the drawing. At a minimum, each flange 256, 258 must extend beyond the point at which the web contacts guide roller 260, 262, as hereinafter described.

Figures 8, 14:
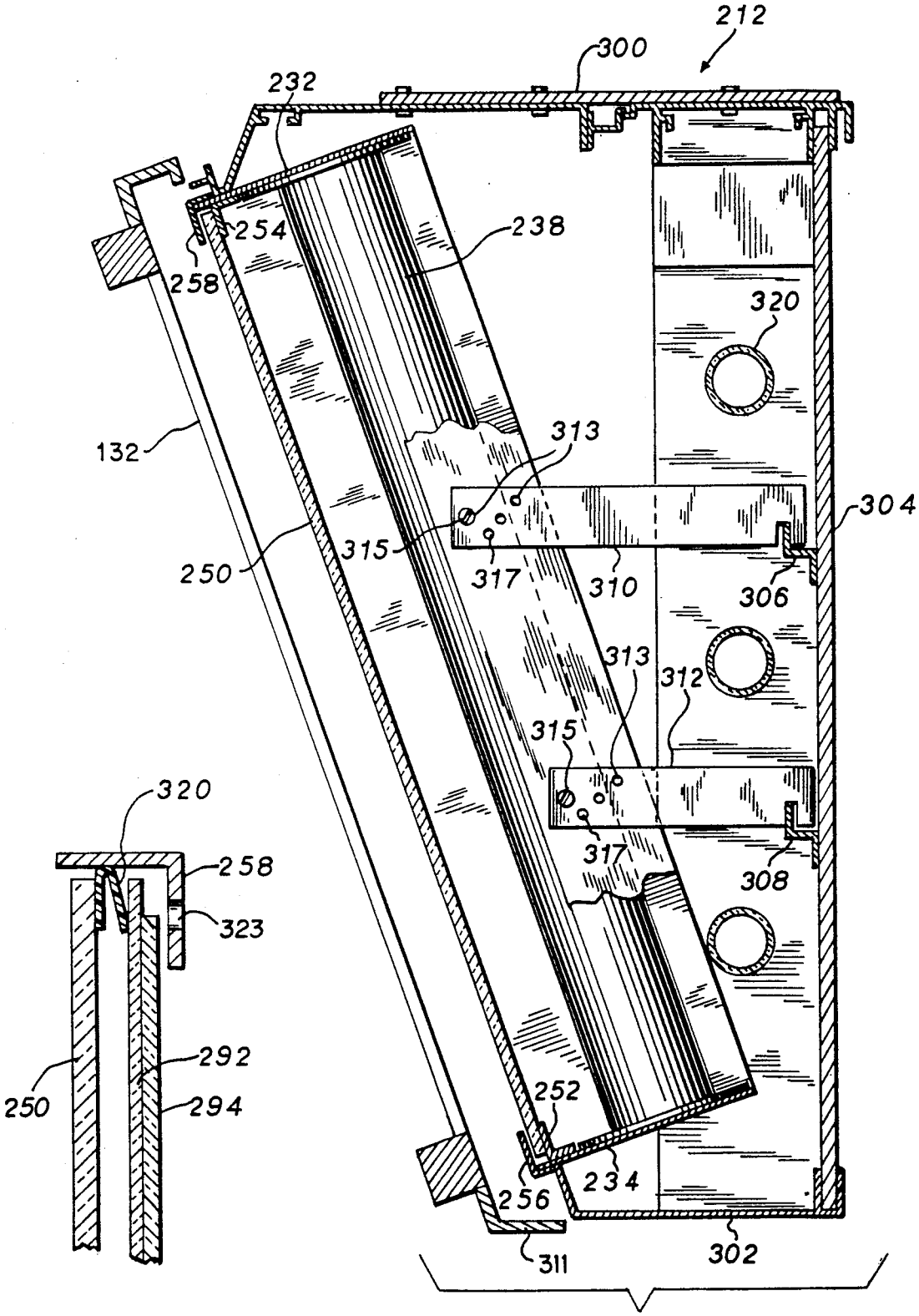
FIG. 8 is a cross sectional view showing the module mounted in the sign.
FIG. 14 is a fragmentary cross sectional view of a portion of the sign.

Web rolls 236 and 238 are mounted for rotation on upper and lower plates 232, 234 as shown in FIG. 14. Motor mounting bracket 270 is mounted on the lower surface of upper plate 232 to mount motor 272. Motor 272 drives speed reducing gear box 274. The output shaft of gear box 274 extends to the rotor of clutch 276. The housing of clutch 276 is fastened to plug 278 that, in turn, is fastened to web roll 238. Clutch 276 may be of the electrically operated type having a low voltage field coil that serves, when energized, to couple the rotor mounted on the output shaft of gear box 274 with an armature drivingly connected to the housing and to web roll 238 to cause the shaft to rotate the web roll. When the field coil is de-energized, driving engagement of the armature with the rotor is lost and the shaft does not drive the web roll. Further details of the drive mechanism are provided in U.S. Pat. No. 4,741,118.

In the lower end of web roll 238, plug 280 is journaled for rotation on pin 282. Spring member 284 surrounding plug 280 provides a retarding action that tensions the web, in the manner described in the aforesaid U.S. Pat. No. 4,741,118. Specifically, spring member 284 provides a greater amount of braking or retarding action when the web is being unwound from a web roll than when it is being rewound onto a web roll. This prevents free wheeling of the web rolls during operation of the scrolling sign and permits a reduction in motor size.

The construction of web roll 236 corresponds to that of web roll 238 described in detail above.

FIG. 12 shows web 290 incorporated in the sign of the present invention and which extends between web rolls 236 and 238 in the manner shown in FIG. 13. Web 290 includes a flexible strip 292. Strip 292 is typically formed of a transparent or translucent material, such as polycarbonate or other suitable plastic that permits the web to be back lit by lights 222. Polycarbonate plastic is advantageous in that it can act as a filter of the ultraviolet light of lights 220 for information placed on panels 294 applied to the front side of strip 292. Strip 292 may have markers 293 for operating an automatic indexing system for web 290. Markers 293 may comprise opaque portions of the web or small magnets.

Each of panels 294 may be held onto strip 292 by an adhesive tape 296.

To affix a panel 294 to strip 292, one end of the panel is properly positioned on strip 292 and taped to the strip. To this end, guide lines 298 and other indicia are provided at intervals along strip 292. The distance between adjacent guide lines 298 is slightly less than the length of panel 294. This causes panel 294 to bulge or bow when taped at the guide lines and strip 292 is flat. In the embodiment of the invention shown in FIG. 13, the distance between adjacent guide lines 298 is less than, or approximately that of, the distance between guide rollers 260, 262 so that panel 294 is between the rollers when viewed through windows 214, 216 or 218 of sign 210.

To mount panel 294 on strip 292, one end of the panel is taped to the strip. The panel 294 and strip 292 are then advanced so that the taped end is rolled up on one of the web rolls 236, 238. The remaining end of panel 294 is then taped to strip 292. No bulges will occur in the strip and panel when rolled up on rolls 236, 238 because the distance between guide lines 298 on strip 292 is less than the length of panel 294. This causes strip 292 on the inside of the roll to have a smaller radius of curvature than panel 294 on the outside of the roll.

Panel 294 may be removed from strip 292 by loosening tape 296.

As shown most clearly in FIG. 8, the housing 212 for sign 210 has an upper wall 300, lower wall 302 and back wall 304. Channels 306 and 308 are mounted on back wall 304. Brackets 310 and 312 extending between columns 240 and 242 and channels 306 and 308 for removably mounting sign module 230 in housing 212. Brackets 310 and 312 may have a plurality of mounting holes 313 to mount the brackets in different positions on the columns so as to accommodate different types of housings by means of fastening apparatus such as bolts 315 and pins 317. Plate 234 is proximate lower wall 302 or an extension thereof. The front of housing 212 includes removable frames 311 that surround the windows of sign 210. Frames 311 are fastened to housing 212 in an appropriate manner.

While the foregoing description describes an embodiment of the invention in which the graphic or informational materials are printed on separate panels 294 that are attached to web 292, it will be understood that portions of the web may contain printed material, such as standard displays or information and other portions of the web left blank to permit the attachment of separate panels 294 containing further graphic and informational materials.

In operation, the spacing between guide flanges 252, 254-sheet 250 and guide flanges 256, 258 serves to position the bulges in panels 294 that are formed when strip 292 extends across window 214, 216, or 218 at one or both ends of the portion exposed to the window, as shown in FIG. 13. Typically, as the web passes the window from one web roll to another, the web will be "squeezed" in the narrow portion of the gap between guide flanges 252, 254 and 256, 258. This will tend to cause the bulge, or the larger bulge, to occur in the trailing direction of the web, as shown in FIG. 3. In FIG. 8, the web is moving from left to right, as shown by arrow 319. This will cause bulge 322 to appear at the trailing or left side of the web. No ripples will appear on the web as viewed by an observer since the web bulges toward the window or is outside the viewing area. A highly aesthetic appearance to the sign is thus provided to sign 210.

The extension of guide flanges 256, 258 with respect to guide rollers 260, 262 assists in the smooth scrolling of web 290 in the sign notwithstanding the presence of panel 294 and tape 296 on the outer surface of strip 292 by insuring that these elements properly enter the gap between guide flanges 252, 254 and 256, 258. Guide flanges 252, 254 and 256, 258 particularly insure that extreme upper and lower portions of the vertical edges of panel 294 properly enter the gap between the guide flanges. These portions may not be taped to strip 292 since they are behind the flanges when the taping operation is carried out.

The narrow portion of the gap between guide flanges 252, 254 and 256, 258 also assists in positioning a panel 294 on strip 292 as by pinching the panel and strip together before and during the time tape 296 is being applied. This facilitates the positioning of the panel on the strip in the vertical direction. Sheet 250 lying behind strip 292 receives the pressure applied to tape 296 when fastening panel 294 to strip 292.

While the invention has been described above as employing a curved sheet 250 and flange 252 construction, it will be appreciated that a straight flange with shims may be used to achieve the same result. Further, while the gap has been shown in FIGS. 11 and 13, and described above, as having a narrowed portion, it will be appreciated that the entire length of the gap may be narrowed so that the bulges in panel 294 appear at the ends of panel 294, as shown in FIG. 3. Also, it would be possible to use resilient means to accommodate the bulging of panel 294 and the passage of indexing markers 293, such as small magnets. For example, as shown in FIG. 14, a folded, stiff, resilient, lubricious tape 320, such as a vinyl or polytetrafluoroethylene tape, may be employed for this purpose. One or more of guides 252, 254, sheet 250, and guide flanges 256, 258 could be resiliently mounted on plates 232, 234, if desired.

Also as shown in FIG. 14, holes 323 may be provided in flanges 256 and 258 to assist in positioning panels 294 vertically on strip 292. The upper and lower edges of panels 294 may be viewed through the holes and aligned with horizontal diameters of the holes when positioning the panel.

While the invention has been described above in an exemplary manner as a menu board, it will be appreciated that the invention is suitable for numerous other applications, such as outdoor billboards and signs, movie marquees, and the like.

Various modes of carrying out the present invention are contemplated as being within the scope of the following claims particularly pointing out and distinctly claiming the subject matter which is regarded as the invention.

I claim:

1. A scrolling sign apparatus suitable for incorporation in a sign housing having a window, said apparatus comprising:

a sign module positionable within said housing;

a pair of spaced web rolls journaled for rotation in said module;

a web mounted on said rolls for being unwound and rewound on said rolls for movement along a path extending between said rolls and across said window;

a first guide means mounted in said module behind said web;

a second guide means mounted in said module on the other side of said web to form a gap with said first guide means through which said web extends between said rolls, said gap including a wide portion and a narrow portion, said narrow portion extending along at least a portion of said path of said web; and said web having at least one flexible, resilient panel containing viewing material mounted thereon, said panel having an outer edge lying parallel to the path of movement of said web and disposed in the gap between the first and second guide means when the viewing material is in the window, said panel being so mounted on said web that said web and panel can be rolled up tightly on said rolls, the slack occurring in said panel when said panel appears in the window being forced to the ends of said panel by the narrow portion of the gap between said first and second guide means.

2. The scrolling sign apparatus according to claim 1 wherein said narrow portion is generally centrally located along the path between said rolls.

3. The scrolling sign apparatus according to claim 1 wherein said first guide means is curved to configure said gap to have a narrow portion.

4. The scrolling sign apparatus according to claim 1 wherein one of said first and second guide means has resilient means mounted thereon for rendering said gap configurable to have a narrow portion.

5. The scrolling sign apparatus according to claim 1 further including idler rollers for said web mounted in said module at the ends of said first guide means and over which said web passes when entering and leaving said gap, the exterior surface of said idler rollers being generally aligned with said first guide means.

6. The scrolling sign apparatus according to claim 1 further including idler rollers for said web mounted in said module at the ends of said first guide means and over which said web passes when entering and leaving said gap, said second guide means extending beyond said guide rollers along an extension of said path in either direction beyond the ends of said first guide means.

7. The scrolling sign apparatus according to claim 1 wherein said first guide means includes a sheet mounted behind said web.

8. The apparatus according to claim 3 wherein said informational material panel is fastened to said web by adhesive tape and wherein the sheet mounted behind said web receives the pressure applied to said adhesive tape when fastening said panel to said web.

9. The scrolling sign apparatus according to claim 1 wherein said second guide means has means for assisting the positioning of said panel on said web.

10. The apparatus according to claim 9 wherein said positioning assistance means comprises means for viewing the position of said panel on said web and for ascertaining when said web is in a desired position on said web.

11. The apparatus according to claim 9 wherein the narrow portion of said gap is adapted for temporarily retaining said panel in a desired position on said web.

12. The apparatus according to claim 9 wherein the narrowing of said gap is such as to temporarily retain said panel in a desired position on said web while said panel is being fastened to web by said adhesive tape.

* * * * *